US007134908B2

(12) United States Patent
Wu

(10) Patent No.: US 7,134,908 B2
(45) Date of Patent: Nov. 14, 2006

(54) SINGLE-PORT TO MULTI-PORT CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/898,070

(22) Filed: Jul. 23, 2004

(65) Prior Publication Data

US 2006/0019542 A1 Jan. 26, 2006

(51) Int. Cl.
*H01R 11/00* (2006.01)

(52) U.S. Cl. ..... 439/502; 439/638; 439/639

(58) Field of Classification Search ..... 439/638, 439/639, 651, 652, 653, 654, 499, 502
See application file for complete search history.

(56) References Cited

U.S. PATENT DOCUMENTS 4,424,403 A * 1/1984 Bogese, II ..... 174/36
5,938,462 A * 8/1999 Wilson et al. ..... 439/215
6,203,376 B1 * 3/2001 Magajne et al. ..... 439/610
6,503,098 B1 * 1/2003 Aoki et al. ..... 439/502
6,648,676 B1 * 11/2003 Lee ..... 439/499
6,719,591 B1 * 4/2004 Chang ..... 439/638
6,824,426 B1 * 11/2004 Spink, Jr. ..... 439/579

* cited by examiner

*Primary Examiner*—Chandrika Prasad
(74) *Attorney, Agent, or Firm*—Wei Te Chung

(57) ABSTRACT

A cable assembly (100) includes a first connector (1), a number of second connectors (2) each having a serial advanced technology attachment interface, and cable means (3) connecting the first and the second connectors. The first connector includes a unitary first longitudinal insulative housing (10) having an upper and a lower elongated side walls (1040, 1041) opposite to each other in a lateral direction and respectively defining a plurality of first and second passageways therein, a number of signal contacts disposed in corresponding first passageways, and a number of power contacts disposed in corresponding second passageways. The cable means includes a plurality of sets of wires, each set electrically connecting with the first connector and a corresponding second connector.

3 Claims, 8 Drawing Sheets

SINGLE-PORT TO MULTI-PORT CABLE ASSEMBLY

BACKGROUND OF THE INVENTION

1. Field of the Invention

The present invention relates generally to a cable assembly, and more particularly to a high speed Serial Advanced Technology Attachment (SATA) cable assembly.

2. Description of the Prior Art

Parallel ATA (Advanced Technology Attachment) and parallel SCSI (Small computer System Interface) are two dominant disk interface technologies in past long period. The parallel ATA disks are widely used in desktop PCs and mobile PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors—a pitfall that has been remedied by slowing the signal, limiting cable length or both. In view of the requirements for a high-speed transmission, an organization, named Serial ATA (SATA) Working Group proposes a specification defining a SATA interface. SATA interface is developed with a fast signal transmission speed of up to 1.5 Gbps between storage devices (such as hard disks, floppy drives, CD-ROMs, and DVDs) and a motherboard. Numerous advantages of SATA make it gradually replace Parallel ATA and Parallel SCSI interfaces and become the next generation personal computer storage interface. Correspondingly, SATA connectors and SATA cable assemblies have been designed and developed by many companies in the art.

A conventional SATA cable connector assembly is disclosed in art for connecting a first electrical device, such as a motherboard in a personal computer or a server with a second electrical device, such as a hard disk of the personal computer or the server. The cable connector assembly comprises cable means having opposite two ends, and a first and a second connectors each connected to one end of the cable means. The first and the second connectors both receive a plurality of power and signal contacts. The cable means comprises power cables for transmitting power between the first and the second connectors and signal cables for transmitting signal between the first and the second connectors. Therefore, one such one-to-one cable assembly is only for connecting the motherboard with one hard disk. As widely known, a storage device of the personal computer or the server has only a limited storage capability, which is hard to meet users' higher and higher requirements. In this case, a motherboard having at least two SATA interfaces which can simultaneously connect with at least two hard disks gradually springs up in nowaday market. Correspondingly, at least two SATA cable assemblies with mentioned structure are simultaneously used to transmit signal and power between a motherboard and at least two hard disks. However, using large numbers of cable assemblies must increase complexity and occupy larger space in the electrical device.

Another conventional SATA cable assembly entitled "SATA INTERFACE RELAY CONNECTOR AND ITS APPLICATION" is disclosed in U.S. Pat. No. 6,719,591. The cable assembly comprises a repeator connector 11 having a signal section 11*a* and a power supply section 12*a*, a signal connector 11*c*, a power input connector 12*b*, a signal cable 11*b* for connecting the signal section 11*a* with the signal connector 11*c*, and a power cable 12*d* for connecting the power supply section 12*a* and the power input connector 12*b*. The cable assembly is used for transmitting signals between a computer and a peripheral device, such as a 5.25-inch CD ROM, DVD ROM, CD-R, and CD-RW drives as well as mobile racks. However, the similar problem is existed. When the computer wants to communicate with a plurality of peripheral devices, a number of cable connector assemblies have to be used.

Hence, in this art, a new type SATA cable assembly to overcome the above-mentioned disadvantages of the prior art will be described in detail in the following embodiments.

BRIEF SUMMARY OF THE INVENTION

A primary object, therefore, of the present invention is to provide a high-speed cable assembly for transmitting signals between a first electrical device and at least two second electrical devices.

Another object, therefore, of the present invention is to provide an electrical connector with a plurality of power and signal contacts respectively arranged in different side walls of a housing for connecting with at least two SATA connectors.

In order to implement the above object and overcomes the above-identified deficiencies in the prior art, the high speed cable assembly in accordance with the present invention comprises a first connector, a plurality of second connectors each having a serial advanced technology attachment interface, and cable means connecting the first connector and the second connectors. The first connector comprises a first longitudinal insulative housing having an upper and a lower elongated side walls opposite to each other in a vertical direction and respectively defining a plurality of first and second passageways therein, a plurality of first contacts disposed in corresponding first passageways, and a plurality of second contacts disposed in corresponding second passageways. The cable means comprises a plurality of sets of wires, each set electrically connecting with the first connector and a corresponding second connector.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to preferred embodiments of the present invention.

Figure 1:
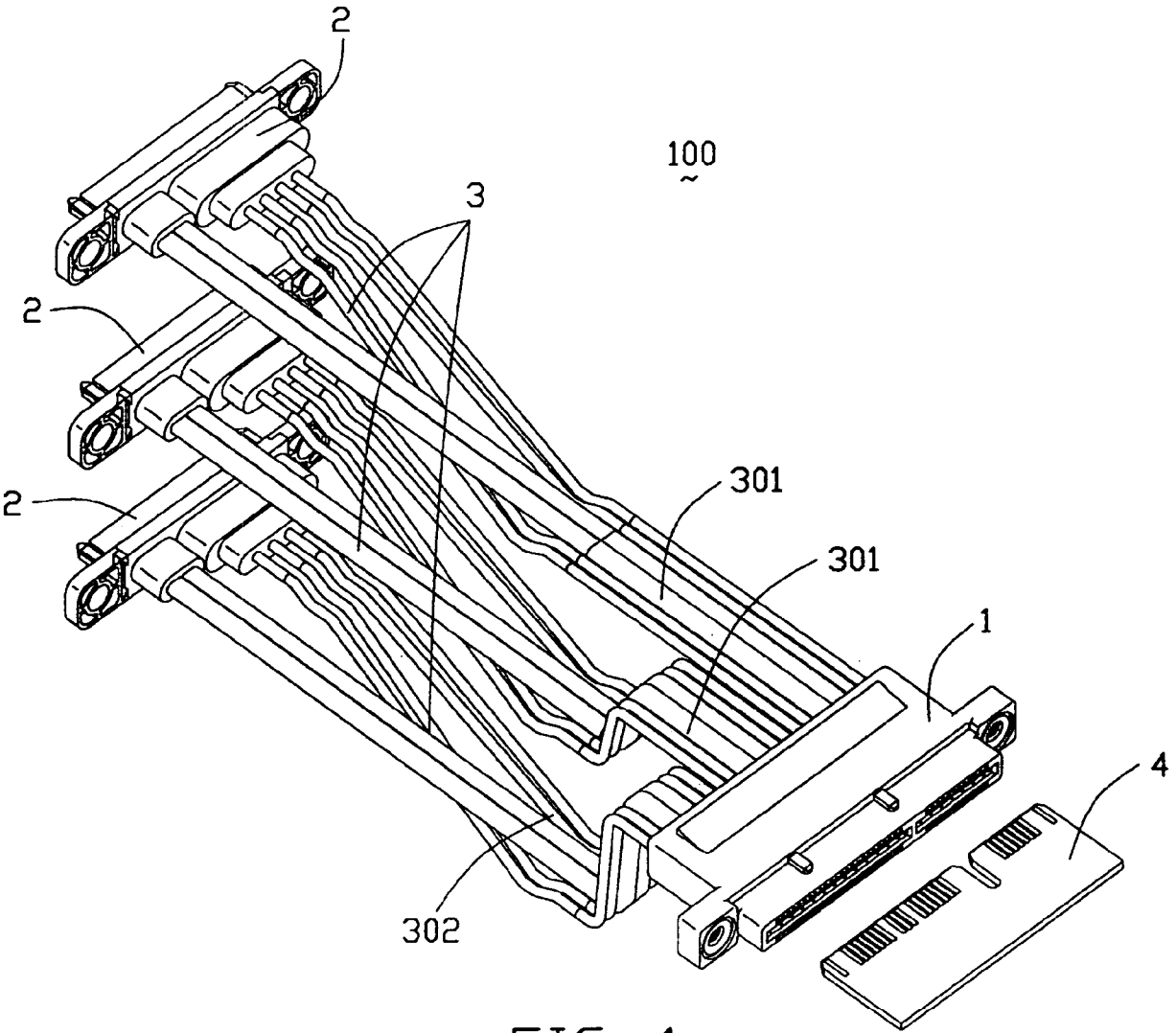
FIG. 1 is a perspective view of a cable assembly in accordance with the present invention in conjunction with a corresponding edge card.

Referring to FIG. 1, a cable assembly 100 in accordance with a first preferred embodiment of the present invention comprises a first connector 1 for mating with an edge card 4, a plurality of second connectors 2 each for connecting to a complementary connector (not shown), and cable means 3 connecting the first and the second connectors 1 and 2 and comprising a plurality of sets, each terminated to one second connector 2.

Figure 2:
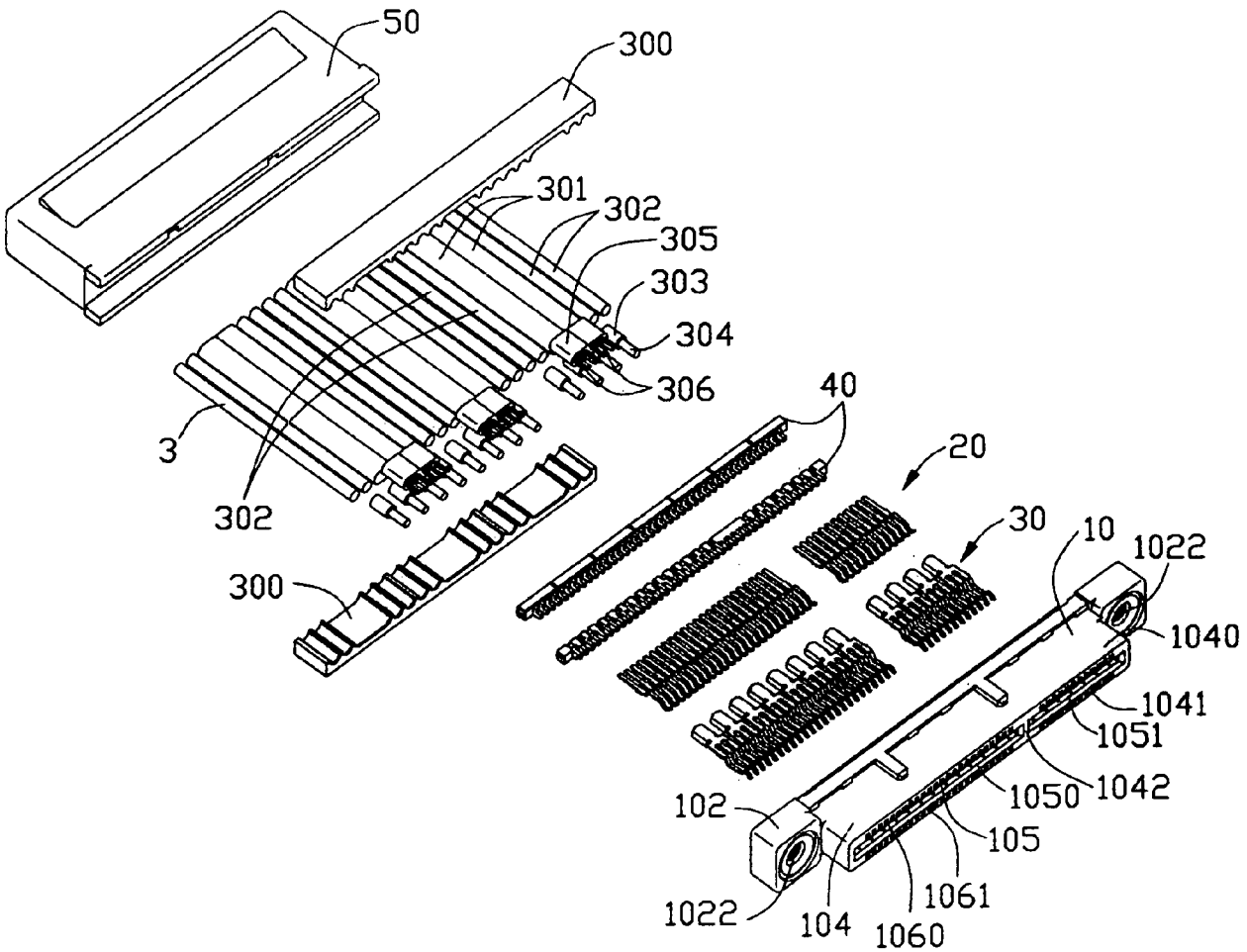
FIG. 2 is an exploded view of a first connector of the cable assembly.
Figure 3:
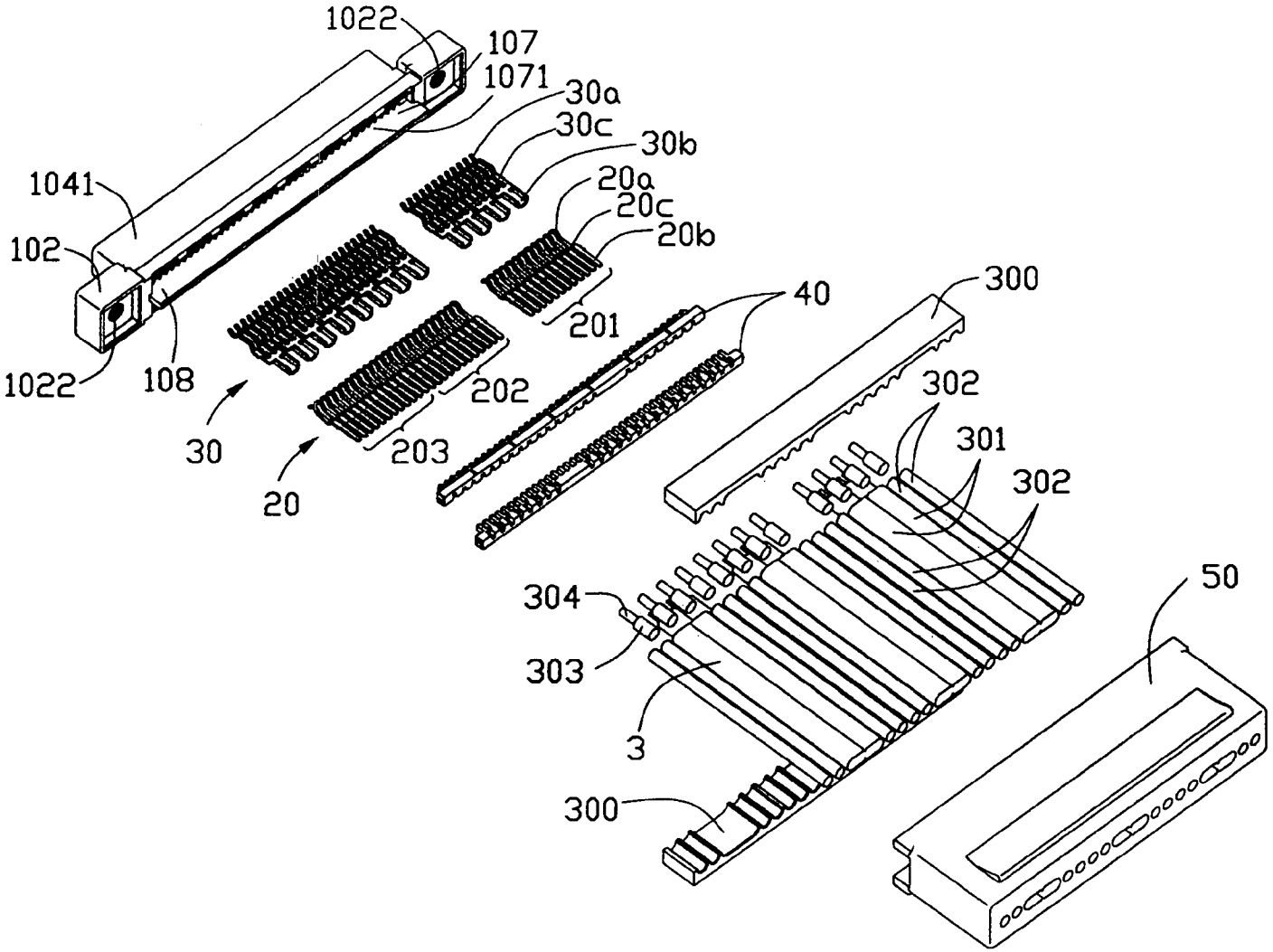
FIG. 3 is an exploded view of the first connector of the cable assembly in another point of view different from FIG. 2.
Figure 4:
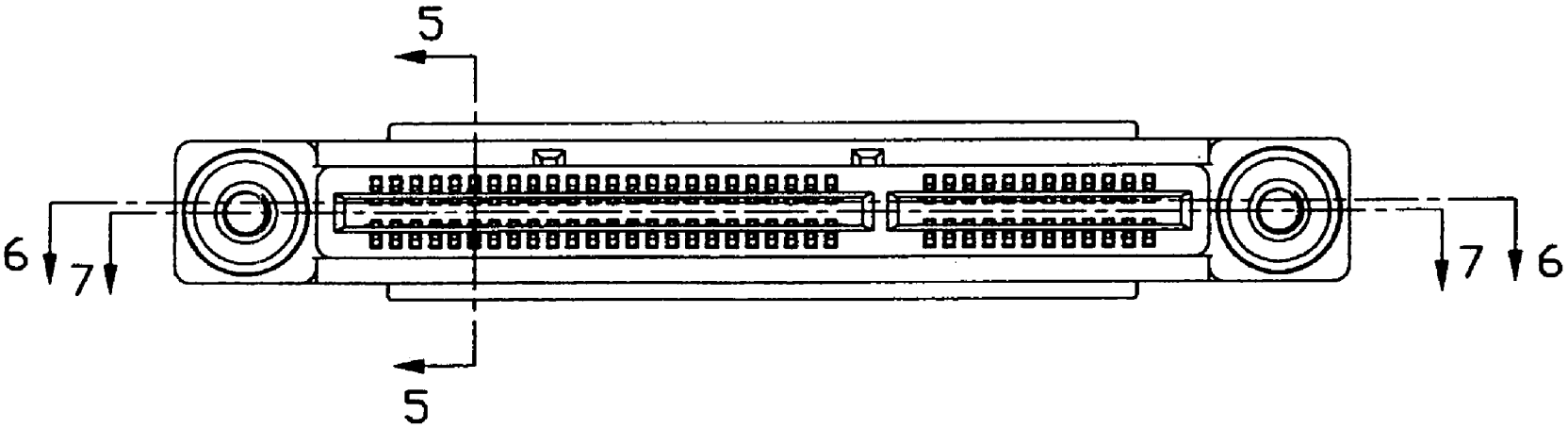
FIG. 4 is a front view of the first connector of the cable assembly.

Referring to FIGS. 2–3, an exploded first connector 1, in conjunction with the cable means 3 is shown in different aspect of views. The first connector 1 comprises an first insulative housing 10, a plurality of first and second contacts 20, 30 retained in the first insulative housing 10, two spacers 40 and a cover 50.

The first housing 10 has an elongated base 102 and a mating section 104 extending perpendicularly and outwardly forming a front face of the base 102. The mating section 104 comprises parallel first and second side walls 1040, 1041 corresponding to each other in a vertical direction and defines a mating port 105 between the first and the second side walls 1040, 1041. The mating port 105 is obscured into side-by-side first and second mating ports 1050, 1051 by a baffle 1042, wherein the first mating port 1050 has a lengthwise dimension smaller than the second mating port 1051. The base 102 defines a longitudinal central cavity 107 communicating with the mating port 105. The base 102 further defines a pair of mounting holes 1022 adjacent opposite ends thereof.

In conjunction with FIGS. 4–7, the housing 10 is integrally formed with a clapboard 108 extending rearwardly therefrom. The clapboard 108 is parallel to the first and second side walls 1040, 1041 and divides the central cavity 107 into an upper and a lower cavities 1070, 1071. The housing 10 defines a plurality of first passageways 1060 in the first side wall 1040 communicating with the upper cavity 1070, and a plurality of second passageways 1061 in the second side wall 1041 communicating with the lower cavity 1071.

Figure 5:
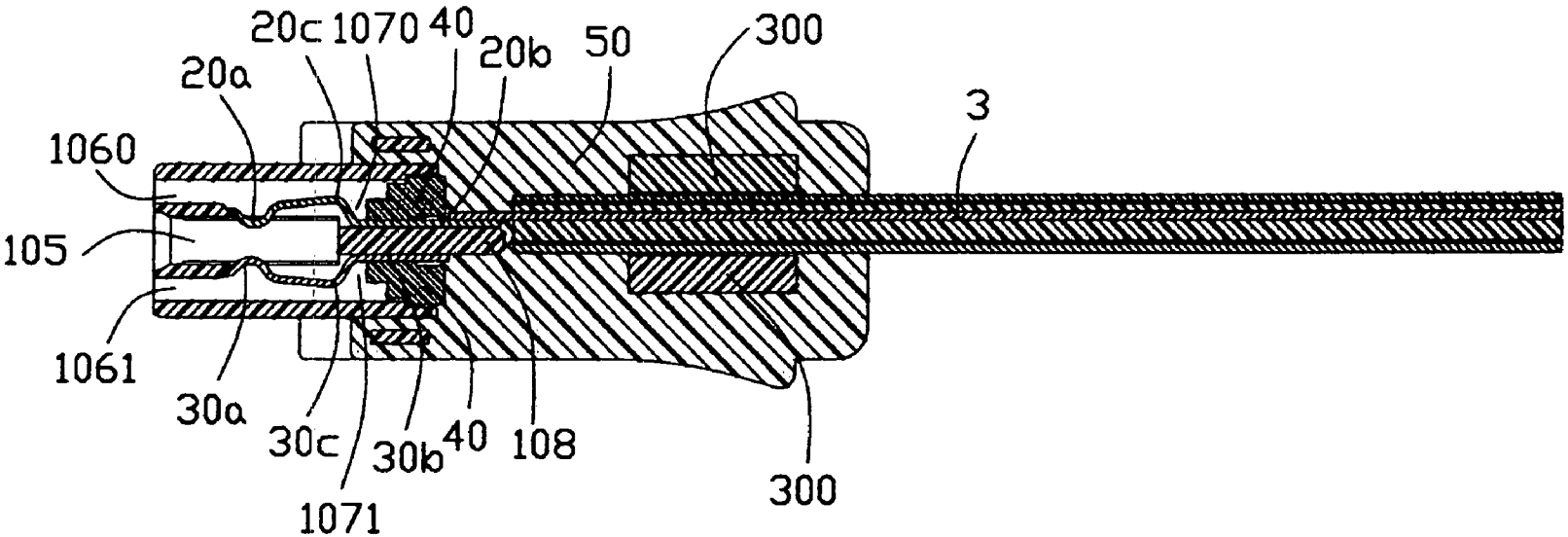
FIG. 5 is a cross-sectional view of the first connector of the cable assembly taken along line 5—5 of FIG. 4.
Figure 6:
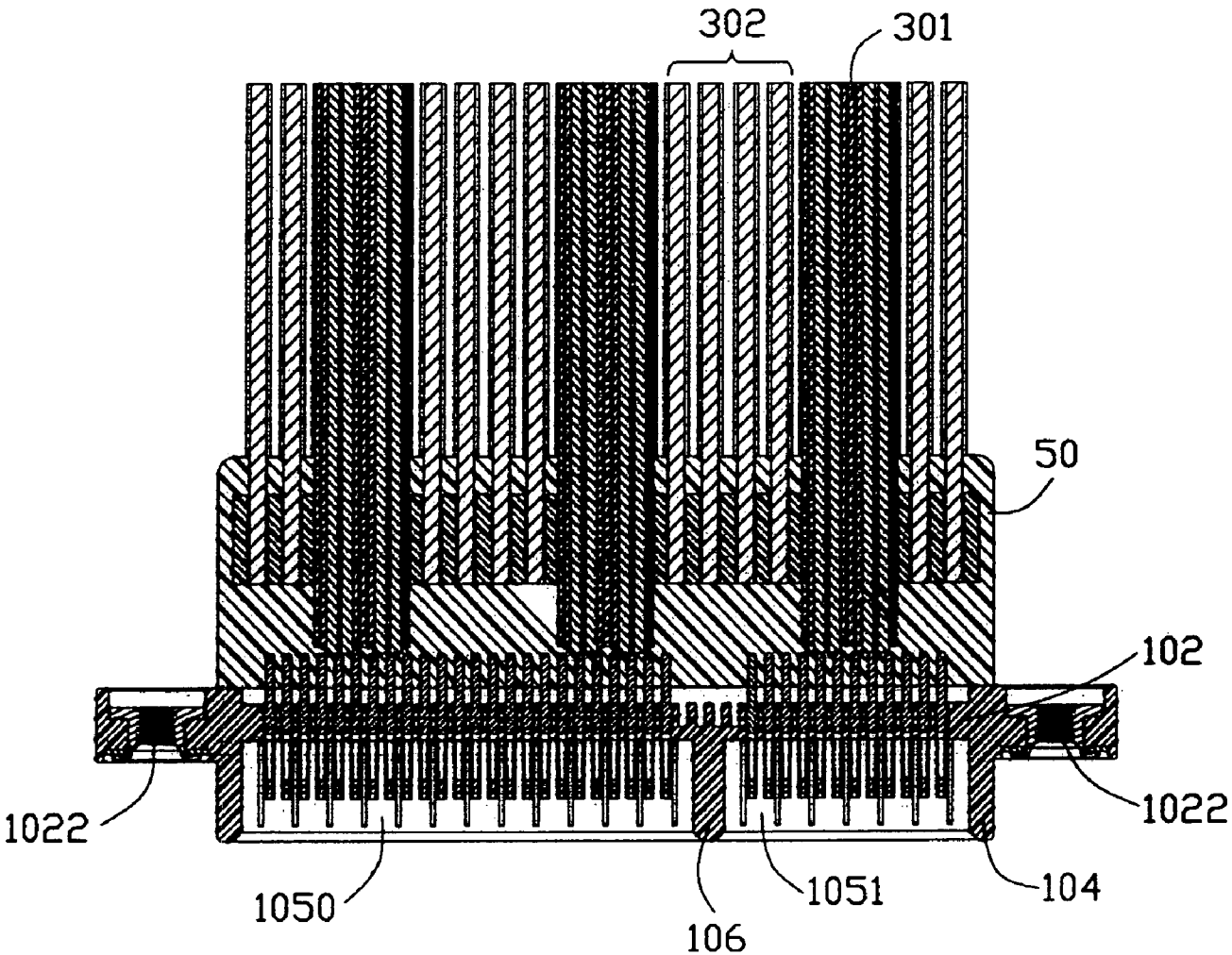
FIG. 6 is a cross-sectional view of the first connector of the cable assembly taken along line 6—6 of FIG. 4.
Figure 7:
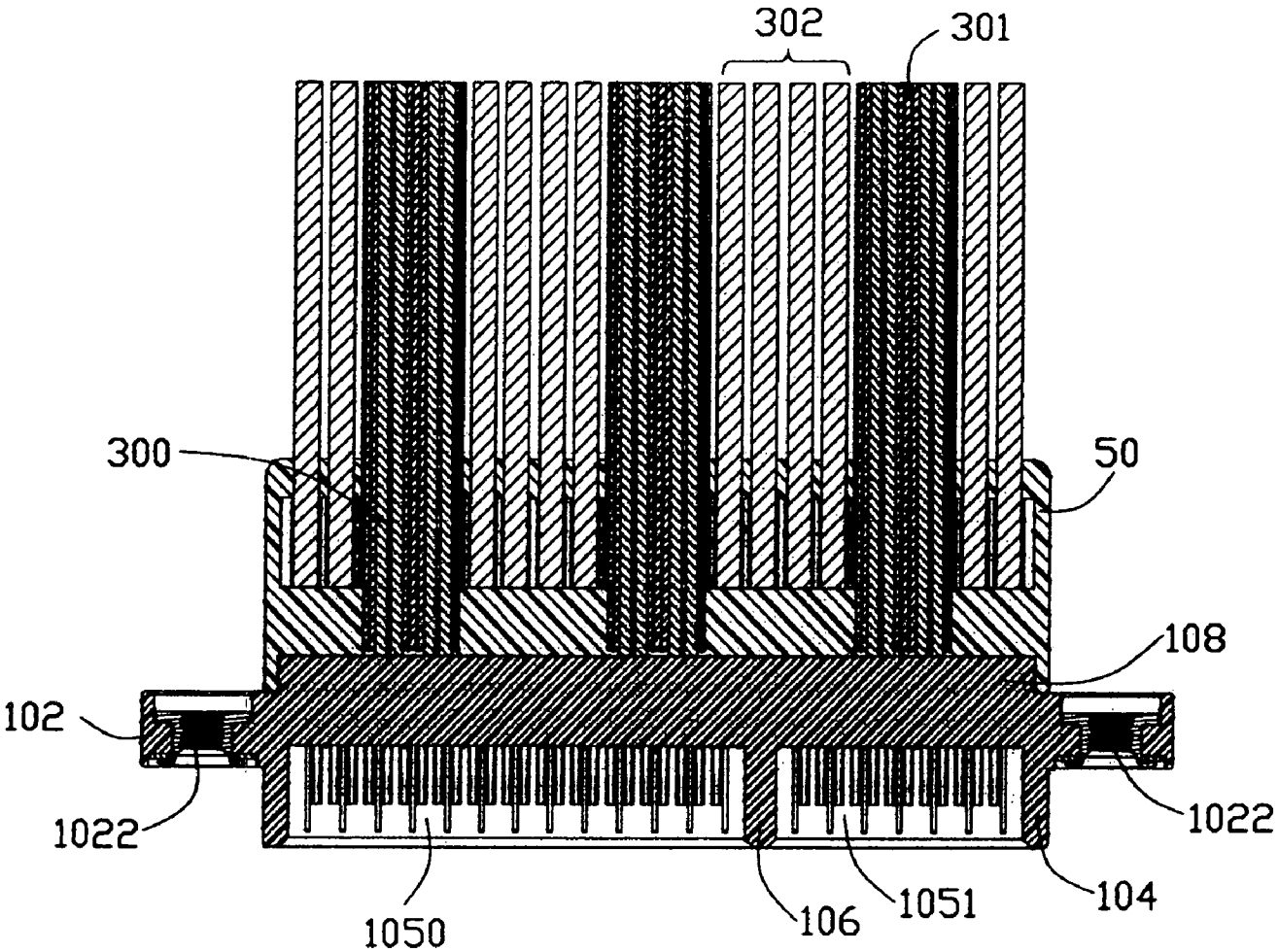
FIG. 7 is a cross-sectional view of the first connector of the cable assembly taken along line 7—7 of FIG. 4.

Referring to FIGS. 3 and 5, the first and the second contacts 20, 30 are assembled into the first and the second passageways 1060, 1061, respectively. The first contacts 20 are signal contacts each comprise a contact portion 20*a* having signal contact section curved into the mating port 105, a tail portion 20*b* rearwardly extending into the upper cavity 1070 and out of the base 102 for connecting to the cable means 3, and an retention portion 20*c* interconnecting the contact portion 20*a* with the tail portion 20*b*. The second contacts 30 are power contacts each comprise a contact member 30*a* having power contact sections curved into the mating port 105. Three contacts members commonly have a tail member 30*b* rearwardly extending into the lower cavity 1071 and out of the base 102 for connecting to the cable means 3. A retention member 30*c* interconnects each contact member 30*a* and corresponding tail member 30*b*.

The spacers 40 have the same configuration and are both made of plastic material. Two spacers 40 are respectively mounted in upper cavity 1070 and lower cavity 1071 from a rear face (not labeled) of the first housing 10 to seal the rear face except for the plurality of passageways through which the tail portions 20*b* of the contacts 20, 30 extend rearwardly.

The cover 50 is over-molded on the base 102 of the first housing 10 with the cable means 3 and the first housing 10. Thus, the electrical cable assembly 100 is formed as best shown in FIG. 1.

Figure 8:
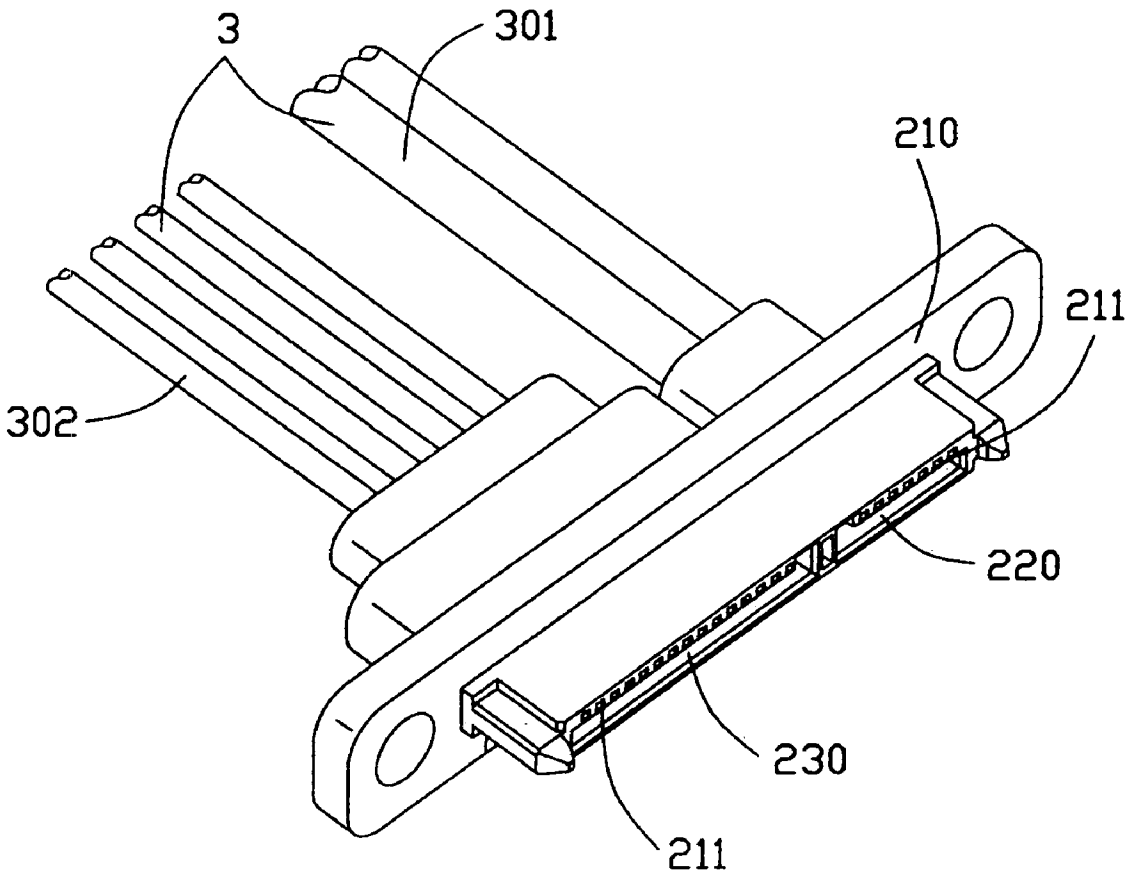
FIG. 8 is a perspective view of a second connector of the cable assembly.

Referring to FIG. 8, the second connectors 2 comprise three connectors having the same structure, each comprising an second insulative housing 210 defining therein a plurality of channels 211 and two L-shaped SATA interfaces arranged in a back-to-back manner in the lengthwise direction, wherein a shorter one is a signal interface 220 and a longer one is a power interface 230. A plurality of signal and power terminals (not shown) are received in the corresponding channels 211 respectively.

Referring again to FIGS. 1–8, the cable means 3 is fixed by two clamps 300 in the cover 50 and comprises a plurality of wires divided into a first set, a second set, and a third set, respectively connected to one of the second connectors 2. Each set of wires comprises a pair of signal wires 301 arranged in side-by-side manner for connecting corresponding signal contacts 20 of the first connector 1 and signal terminals of the second connector 2, and four power wires 302 for connecting the power contacts 30 of the first connector 1 and the power terminals of the second connector 2. Each power wire has a jacket 303 at one end thereof and a conductor 304 extending therefrom for soldering with a corresponding power contact 30. Each signal wire has a wrap 305 at one end thereof and four conductors 306 extending therefrom for soldering with corresponding signal contacts 20.

As easily conceived, the cable assembly 100 in accordance with another embodiment of the present invention comprises two or more than three second connectors 2 having the same structure, each for connecting to a complementary connector. Accordingly, the configuration of the first connector 1, the amount of the contacts 20, 30 and the wires 301, 302 are needed to be alerted to some extent for concerting with the second connectors.

In a third embodiment of the present invention, the plurality of second connectors 2 may have different configurations, while the first connector 1 has a similar configuration as described in the first embodiment. Some of the second connectors 2 are only connected to power wires or only connected to signal wires.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a first set cable including a first set of power wires and a first set of signal wires side by side arranged together;

a second set cable including a second set of power wires and a second set of signal wires side by side arranged together;

a common connector having a large transverse dimension thereof along a transverse direction and connected to both first end of the first set cable and first end of the second set cable;

a first connector having a first small transverse dimension thereof along said transverse direction and connected to a second end of the whole first set cable; and a second connector having a second small transverse dimension thereof along said transverse direction and connected to a second end of the whole second set cable;

wherein said first connector and said second connector are arranged in a stacked manner in a vertical direction perpendicular to said transverse direction.

2. A cable assembly comprising:

a group of cable including a set of power wires, a first set of signal wires and a second set of signal wires;

first and second connectors being opposite to each other along a front-to-back direction, along which said group of cable extends, while both extending along a transverse direction perpendicular to said front-to-back direction;

the set of power wires defines first ends electrically and mechanically connected to the first connector, and second ends electrically and mechanically connected to the second connector;

each set of the first set of signal wires and the second set of signal wires defining first end sections electrically and mechanically connected to the first connector and second end sections electrically and mechanically connected to the second connector; wherein the first end sections of said first set and second set of signal wires are closely neighboring with each other along said transverse direction with the first ends of said power wires aside, while the second end sections of the first set and second set of signal wires are spaced from each other along transverse direction with said second ends of the power wires therebetween.

3. A cable assembly comprising:

a first set cable including a first set of power wires and a first set of signal wires side by side arranged together;

a second set cable including a second set of power wires and a second set of signal wires side by side arranged together;

a common connector having a large transverse dimension thereof along a transverse direction and connected to both first end of the first set cable and first end of the second set cable;

a first connector having a first small transverse dimension thereof along said transverse direction and connected to a second end of the whole first set cable; and a second connector having a second small transverse dimension thereof along said transverse direction and connected to a second end of the whole second set cable;

wherein the first set of power wires and the first set of signal wires are respectively arranged to be separated from each other in the first connector along said transverse direction while are intermingled with each other in said common connector along the transverse direction.

* * * * *